US007166967B2

(12) United States Patent
Cho et al.

(10) Patent No.: US 7,166,967 B2
(45) Date of Patent: Jan. 23, 2007

(54) ENERGY RECOVERING APPARATUS AND METHOD FOR PLASMA DISPLAY PANEL

(75) Inventors: Jang Hwan Cho, Kumi-shi (KR); Won Sik Yoon, Kimhae-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/743,289

(22) Filed: Dec. 23, 2003

(65) Prior Publication Data

US 2004/0207332 A1 Oct. 21, 2004

(30) Foreign Application Priority Data

Apr. 16, 2003 (KR) ..... 10-2003-0023991

(51) Int. Cl.
*G09G 3/10* (2006.01)
*G09G 3/28* (2006.01)

(52) U.S. Cl. ..... 315/169.3; 345/60

(58) Field of Classification Search ..... 315/169.1, 315/169.2, 169.4; 345/60, 62, 68
See application file for complete search history.

(56) References Cited

U.S. PATENT DOCUMENTS 3,780,339 A 12/1973 Mayle ..... 315/27 TD
4,070,663 A 1/1978 Kanatani et al. ..... 340/324
4,707,692 A 11/1987 Higgins et al. ..... 340/811
4,866,349 A 9/1989 Weber et al. ..... 315/169.4
5,081,400 A 1/1992 Weber et al. ..... 315/169.4
5,670,974 A 9/1997 Ohba et al. ..... 345/60
6,680,581 B1 * 1/2004 Lee et al. ..... 315/169.3
6,768,270 B1 * 7/2004 Chae ..... 315/169.3
6,778,153 B1 * 8/2004 Kang ..... 345/60
6,924,779 B1 * 8/2005 Lee et al. ..... 349/60
2003/0193450 A1 * 10/2003 Lee et al. ..... 345/60
2004/0001290 A1 * 1/2004 Yoon et al. ..... 361/15

* cited by examiner

*Primary Examiner*—David Vu
*Assistant Examiner*—Minh Dieu A
(74) *Attorney, Agent, or Firm*—Fleshner & Kim, LLP

(57) ABSTRACT

An energy recovering apparatus and method for a plasma display panel that is capable of supplying a sustain pulse having a rapid rising time. In the apparatus and method, a voltage source supplies a sustain voltage to the panel. A first inductor recovers an energy stored in the panel into the voltage source, and a second inductor receives energy from the voltage source in which the recovered energy has been stored to charge the received energy. Switching devices shuts off a path between the voltage source and the second inductor in a state in which energy has been stored in the second inductor to derive an inverse voltage into the second inductor and allows said inverse voltage to be applied to the panel.

19 Claims, 11 Drawing Sheets

ENERGY RECOVERING APPARATUS AND METHOD FOR PLASMA DISPLAY PANEL

BACKGROUND OF THE INVENTION

1. Field of the Invention

This invention relates to an energy recovering apparatus and method for a plasma display panel, and more particularly to an energy recovering apparatus and method for a plasma display panel that is capable of supplying a sustain pulse having a rapid rising time.

2. Description of the Related Art

Recently, there has been developed various flat panel devices that are capable of reducing a heavy weight and a large bulk, which are drawbacks of the cathode ray tube (CRT). Such flat panel display devices include a liquid crystal display (LCD), a field emission display (FED), a plasma display panel (PDP) and an electro-luminescence display (ELD), etc.

The PDP of these flat panel display devices is a display device using a gas discharge, and has an advantage in that it is easy to manufacture a large-dimension panel. The PDP typically includes a three-electrode, alternating current (AC) surface discharge PDP that has three electrodes and is driven with an AC voltage as shown in FIG. 1.

Referring to FIG. 1, a discharge cell of the conventional three-electrode, AC surface-discharge PDP includes a first electrode 12Y and a second electrode 12Z provided on an upper substrate 10, and an address electrode 20X provided on a lower substrate 18.

On the upper substrate 10 provided with the first electrode 12Y and the second electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a fluorescent material 26. The address electrode 20X is formed in a direction crossing the first electrode 12Y and the second electrode 12Z. The barrier rib 24 is formed in parallel to the address electrode 20X to prevent an ultraviolet ray and a visible light generated by a discharge from being leaked to the adjacent discharge cells. The phosphorous material 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

Such a three-electrode, AC surface discharge PDP is driven with being separated into a number of sub-fields. In each sub-field interval, a light emission having a frequency proportional to a weighting value of a video data is conducted to provide a gray scale display. The sub-field is again divided into an initialization period, an address period, a sustain period and an erasure period.

Herein, the initialization period is a period for forming uniform wall charges on the discharge cell. The address period is a period for generating a selective address discharge in accordance with a logical value of the video data. The sustain period is a period for allowing a discharge cell in which the address discharge has been generated to sustain a discharge. The erasure period is a period for erasing a sustain discharge generated in the sustain period.

The address discharge and the sustain discharge of the AC surface-discharge PDP driven in the above manner requires a high voltage more than hundreds of volts. Accordingly, an energy recovering apparatus is used for the purpose of minimizing a driving power required for the address discharge and the sustain discharge. The energy recovering apparatus recovers a voltage between the first electrode 12Y and the second electrode 12Z, to thereby use the recovered voltage as a driving voltage upon the next discharge.

Referring to FIG. 2, energy recovering apparatus 30 and 32 of the PDP having been suggested by U.S. Pat. No. 5,081,400 of Weber are symmetrically arranged with respect to each other with having a panel capacitor Cp therebetween. The panel capacitor Cp is an equivalent expression of a capacitance formed between the first electrode Y and the second electrode Y. The first energy recovering apparatus 30 applies a sustain pulse to the first electrode Y. The second energy recovering apparatus 32 operates alternately with respect to the first energy recovering apparatus 30 to thereby apply a sustain pulse to the second electrode Z.

Hereinafter, configurations of conventional energy recovering apparatus of the PDP will be described with reference to the first energy recovering apparatus 30.

The first energy recovering apparatus 30 includes an inductor L connected between a panel capacitor Cp and a source capacitor Cs, first and third switches S1 and S3 connected, in parallel, between the source capacitor Cs and the inductor L, and second and fourth switches S2 and S4 connected, in parallel, between the panel capacitor Cp and the inductor L.

The second switch S2 is connected to a sustain voltage source VS while the fourth switch S4 is connected to a ground voltage source GND. The first to fourth switches S1 to S4 control a current flow.

The source capacitor Cs recovers and charges a voltage charged in the panel capacitor Cp upon sustain discharge and re-supply the charged voltage to the panel capacitor Cp. The source capacitor Cs is charged with a voltage Vs/2 equal to a half value of the sustain voltage source Vs.

The inductor L forms a natural resonance circuit along with the panel capacitor Cp. At this time, the conventional energy recovering apparatus allows a step of storing energy into the inductor L to overlap with a step of supplying the panel capacitor Cp with the energy stored in the inductor L.

Meanwhile, fifth and sixth diodes D5 and D6 provided between the first and second switches S1 and S2 and the inductor L, respectively prevent a current from flowing in a backward direction.

FIG. 3 is a timing diagram and a waveform diagram representing an on/off timing of switches in the first energy recovering apparatus and an output waveform of the panel capacitor.

An operation procedure of the energy recovering apparatus will be described assuming that 0 volt has been charged in the panel capacitor Cp and a Vs/2 voltage has been charged in the source capacitor Cs prior to a T1 interval.

In a T1 interval, the first switch S1 is turned on, to thereby form a current path extending from the source capacitor Cs, via the first switch S1, the inductor L, into the panel capacitor Cp. If the current path is formed, then a Vs/2 voltage charged in the source capacitor Cs is applied to the panel capacitor Cp. At this time, a Vs voltage equal to twice the voltage of the source capacitor Cs is charged in the panel capacitor Cp because the inductor L and the panel capacitor Cs form a serial resonance circuit.

In a T2 interval, the second switch S2 is turned on. If the second switch S2 is turned on, then a voltage of the sustain voltage source Vs is applied to the first electrode Y. The voltage of the sustain voltage source Vs applied to the first electrode Y prevents a voltage Vcp of the panel capacitor Cp from falling into less than the sustain voltage source Vs to thereby cause a normal sustain discharge. Meanwhile, since the voltage Vcp of the panel capacitor Cp has risen into Vs in the T1 interval, a driving power supplied from the exterior for the purposing of causing the sustain discharge is minimized.

In a T3 interval, the first switch S1 is turned off. At this time, the first electrode Y sustains a voltage of the sustain voltage source Vs during the T3 interval. In a T4 interval, the second switch S2 is turned off while the third switch S3 is turned off. If the third switch S3 is turned off, then a current path extending from the panel capacitor Cp, via the inductor L and the third switch S3, into the source capacitor Cs is formed to recover a voltage Vcp charged in the panel capacitor Cp into the source capacitor Cs. At this time, a Vs/2 voltage is charged in the source capacitor Cs.

In a T5 interval, the third switch S3 is turned while the fourth switch S4 is turned on. If the fourth switch S4 is turned on, then a current path between the panel capacitor Cp and the ground voltage source GND is formed, thereby allowing the voltage Vcp of the panel capacitor Cp to 0 volt. In a T6 interval, the T5 state is maintained during a certain time. In real, an alternating current driving pulse supplied to the first electrode Y and the second electrode Z allows the T1 to T6 intervals to be obtained with repeating periodically.

In the mean time, the second energy recovering apparatus 32 operates alternately with respect to the first energy recovering apparatus 30. Accordingly, a sustain pulse voltage Vs having a mutually contrary polarity is applied to the panel capacitor Cp. The sustain pulse voltage Vs having a mutually contrary polarity is applied to the panel capacitor Cp is applied, so that a sustain discharge can be generated from the discharge cells.

However, such conventional energy recovering apparatus 30 and 32 have a problem in that the first energy recovering apparatus 30 provided at the first electrode (Y) side and the second energy recovering apparatus 32 provided at the second electrode (Z) side operate individually to require many circuit elements such as a switching device, etc., and thus to raise a manufacturing cost. Furthermore, a lot of power consumption is caused by a conduction loss of a plurality of switches, such as a diode, a switch device and an inductor, etc., on the current path.

Meanwhile, referring to FIG. 4, an energy recovering apparatus for a plasma display panel suggested by U.S. Pat. No. 5,670,974 of NEC corporation includes a panel capacitor 40 equivalently representing a capacitance formed between a scanning electrode and a sustain electrode of the plasma display panel 1, and a charging/discharging circuit 2 and a voltage clamp circuit 3 connected in parallel with the panel capacitor Cp. Particularly, the charging/discharging circuit 2 includes a coil 8 connected in parallel with the panel capacitor 40 of the panel 1 to re-charge a reverse polarity of a resonant current generated when the panel capacitor 40 is discharged, and two switches 12 and 13. The switches 12 and 13 form a bi-directional switch with respect to the coil 8. One side of the panel capacitor 40 is connected, in series, to the two switches 12 and 13 formed from N-channel FET's controlled by different switch drive inputs IN5 and IN6 supplied to their respective gate terminals and reverse current blocking diodes 10 and 11 connected in series with the respective switches 12 and 13. Other side of the panel capacitor 40 is connected to one end of the parallel circuit having the coil 8 and a resistor 9. To the other end of the parallel circuit, the other terminal of the diodes 10 and 11 are connected commonly. The panel capacitor 40 of the panel 1 and the charging/discharging circuit 2 form a parallel resonance circuit. The resistor 9 connected in parallel with the coil 8 of the charging/discharging circuit 2 is a damping resistor provided for the purpose of preventing an oscillation of a waveform.

The voltage clamp circuit 3 includes first to fourth switches 4, 5, 6 and 7, of which the first and third switches 4 and 6 are respectively connected between one of two terminals of the panel capacitor 40 and power source terminals GND and −VS while the second and fourth switches 5 and 7 are respectively connected between the other of the terminals of the panel capacitor 40 and the power source terminals GND and −VS. The first and second switches 4 and 5 are P-channel FET's, and the third and fourth switches 6 and 7 are N-channel FET's. The switches 4, 6 and the switches 5, 7 form the CMOS type circuit structures, respectively. In such an energy recovering apparatus for the plasma display panel, while causing parallel resonance with the parallel resonance circuit formed by the panel capacitor 40 of the panel 1 and the coil 8 in the charging/discharging circuit 2, the clamping is repeated with the operation of the switches 4 to 7, thus reducing the ineffective power.

FIG. 5 is a waveform diagram representing drive voltage and drive current waveforms in the panel shown in FIG. 5. Referring to FIG. 5, waveforms IN1 to IN6 are input waveforms for operating the switches 4 to 7 and FET switches 12 and 13 shown in FIG. 4. A waveform VCP is of the terminal voltage across the panel capacitor 40 and a waveform IL is of the current through the coil 8.

Specifically, an operation procedure will be described assuming that electric charges has never been charged in the panel capacitor 40 of the panel at t=0 prior to the A' period.

In the A' period, if the second switch 4 and the fourth switch 7 are turned on, then a current path extending from the ground voltage source GND, via the first switch 4, the panel capacitor 40 and the fourth switch 7, into a reverse voltage source −VS are formed as shown in FIG. 6A. If the current path is formed in this manner, then electric charges are charged in the panel capacitor 40.

In the B period, if the switch 12 is turned on, then a current path extending from one end of the panel capacitor 40, via the coil 8, the diode 10 and the switch 12, into other end of the panel capacitor 40 is formed as shown in FIG. 6B. If the current path is formed in this manner, then a discharge current from the panel capacitor 40 is applied to the coil 8. At this time, an inverse electromotive force is produced across the coil 8, thus generating a resonant current IL. Subsequently, when the current through the panel capacitor 40 reaches zero, the voltage VCP on the panel capacitor 40 becomes the maximum inverse voltage −VS.

In the C period, with the application of the maximum inverse voltage −VS across the panel capacitor 40, the second switch 5 and the third switch 6 are turned off to thereby form a current path extending from the ground voltage source GND, via the second switch 5, the panel capacitor 40 and the third switch 6, into the inverse voltage source −VS as shown in FIG. 6C. If the current path is formed in this manner, then one end of the third switch 6 in the panel capacitor 40 is clamped to the inverse voltage −VS. At this time, a polarity of the panel capacitor 40 becomes an inverse polarity in the A' period.

In the D period, the switch 13 is turned on after the second and third switches 5 and 6 were turned off. Accordingly, in the D period, a current path extending from other end of the panel capacitor 40, via the switch 13 and the coil 8, into one end of the panel capacitor 40 is formed as shown in FIG. 6D. If the current path is formed in this manner, then electric charges stored in the panel capacitor 40 is discharged through the coil 8. In other words, a reverse current IL flows in the B period. When the voltage VCP of the panel capacitor 40 is raised to become zero, the maximum current flows through the coil 8. Accordingly, the panel capacitor 40 is charged again to the opposite polarity.

Finally, in the A period, when the re-charge of the inverse voltage into the panel capacitor 40 has been finished by a reverse electromotive force, then the switch 13 is turned off while the first and fourth switches 4 and 7 are turned on as shown in FIG. 6E. Accordingly, electric charges of the panel capacitor 40 are maintained until the next cycle. Then, the panel capacitor 40 are repetitively operated from the A' period into until the D period.

As described above, the energy recovering apparatus for the PDP can reduce a charging/discharging power of the panel capacitor 40 with the aid of a resonance action in which timings of the panel capacitor 40, the coil 8 and individual switches are controlled, and can recover most of the ineffective power in a cycle until the next cycle with a reduced number of parts.

However, the energy recovering apparatus suggested by U.S. Pat. No. 5,679,094 of NEC corporation requires an energy recovering circuit and a sustain circuit for each of the scanning electrode and the sustain electrode of the plasma display panel 1 to thereby cause a complex circuit configuration. Accordingly, it has a problem in that a manufacturing cost rises. Furthermore, a conduction loss of a plurality of switches on the current path in the energy recovering apparatus suggested by U.S. Pat. No. 5,679,094 is smaller than that in the energy recovering apparatus suggested by U.S. Pat. No. 5,081,400, but causes a lot of power consumption due to the conduction loss of the switches.

SUMMARY OF THE INVENTION

Accordingly, it is an object of the present invention to provide an energy recovering apparatus and method for a plasma display panel that is capable of supplying a sustain pulse having a rapid rising time.

In order to achieve these and other objects of the invention, an energy recovering apparatus of a plasma display panel according to one aspect of the present invention includes said plasma display panel; a voltage source for supplying a sustain voltage to the panel; a first inductor for recovering an energy stored in the panel into the voltage source; a second inductor for receiving an energy from the voltage source in which the recovered energy has been stored to charge the received energy; and switching devices for shutting off a path between the voltage source and the second inductor in a state in which an energy has been stored in the second inductor to derive an inverse voltage into the second inductor and allowing said inverse voltage to be applied to the panel.

In the energy recovering apparatus, the voltage source includes a first voltage source connected between the panel and the ground voltage source; and a second voltage source connected between the first voltage source and the ground voltage source.

Herein, each of the first and second voltage sources has a voltage value equal to a half of the sustain voltage.

The energy recovering apparatus further includes a first switch for forming a path between the voltage source and the panel such that said sustain voltage of the voltage source is supplied to the panel; a second switch for forming a path among the panel, the first inductor and the voltage source such that an energy from the panel is recovered into the voltage source; and a first diode connected between the second switch and the panel.

The switching devices include a third switch connected between a node positioned between the second inductor and the panel and the ground voltage source; and a fourth switch connected between the second inductor and the second voltage source.

The switching devices further include a second diode connected between the fourth switch and the second inductor; and a third diode connected between a node positioned between the fourth switch and the second diode and the third switch.

Herein, said inverse voltage is generated when the third and fourth switches are turned off in a turned-on state.

The second and third diodes form a path between the second inductor and the panel such that said inverse voltage is supplied to the panel.

An energy recovering method for a plasma display panel according to another aspect of the present invention includes the steps of (A) supplying a sustain voltage from a voltage source to the panel; (B) recovering an energy stored in the panel into the voltage source using a first inductor; (C) receiving an energy from the voltage source in which the recovered energy has been stored to thereby charge the energy into a second inductor; and (D) shutting off a path between the voltage source and the second inductor in a state in which an energy has been stored in the second inductor using the switching devices to derive an inverse voltage into the second inductor and applying said inverse voltage to the panel.

In the energy recovering method, said (A) step includes forming a path between the first and second voltage sources and the panel connected in series using a first switch to thereby apply voltages from the first and second voltage sources to the panel.

Said (B) step includes forming a path between the panel and the second voltage source going by way of the first inductor using a second switch connected between the first inductor and the panel to thereby recover an energy of the panel into the second voltage source.

Said (C) step includes forming a path between the second voltage source and the second inductor using a third switch connected between the second voltage source and the second inductor and a fourth switch connected between the second inductor and a ground voltage source.

Herein, said inverse voltage is generated when the third and fourth switches are turned off in a turned-on state.

Said (D) step includes forming a path among the second inductor, a panel capacitor, a second diode, a first diode and the second inductor using the first diode connected between the third switch and the second inductor and the second diode connected between a node positioned between the first diode and the third switch and the ground voltage source.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
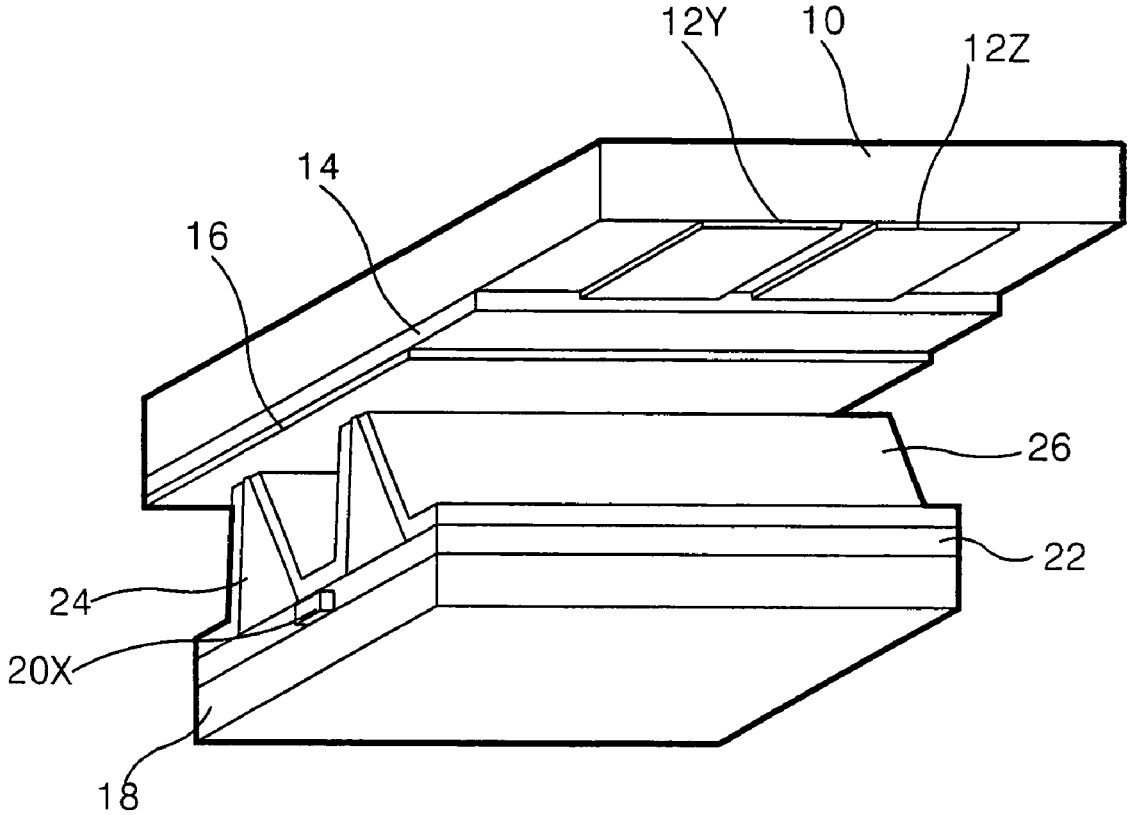
FIG. 1 RELATED ART
FIG. 1 is a perspective view representing a structure of a conventional three-electrode, AC surface-discharge plasma display panel.
Figure 2:
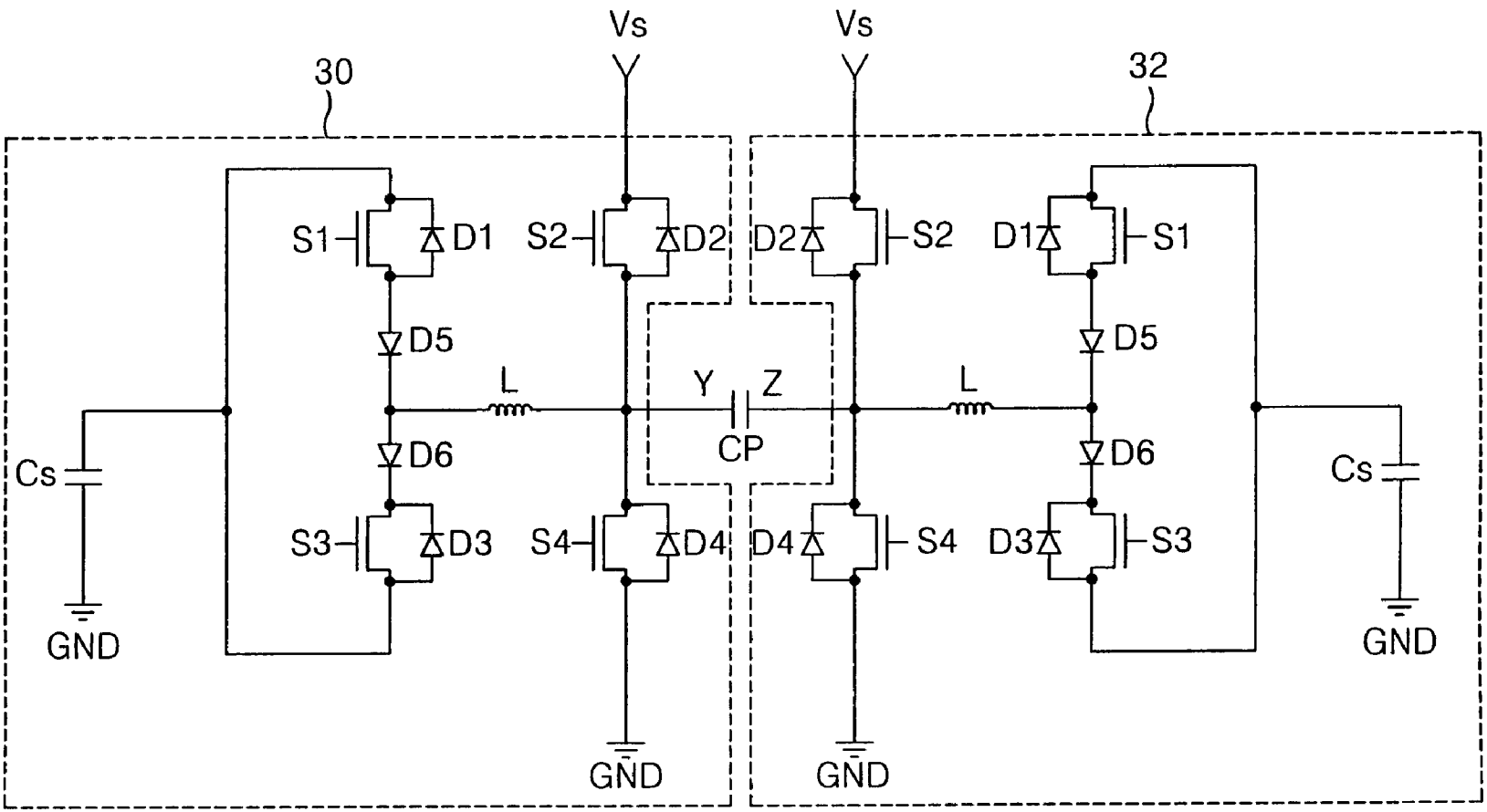
FIG.2 RELATED ART
FIG. 2 is a circuit diagram of a conventional energy recovering apparatus of the plasma display panel.
Figure 3:
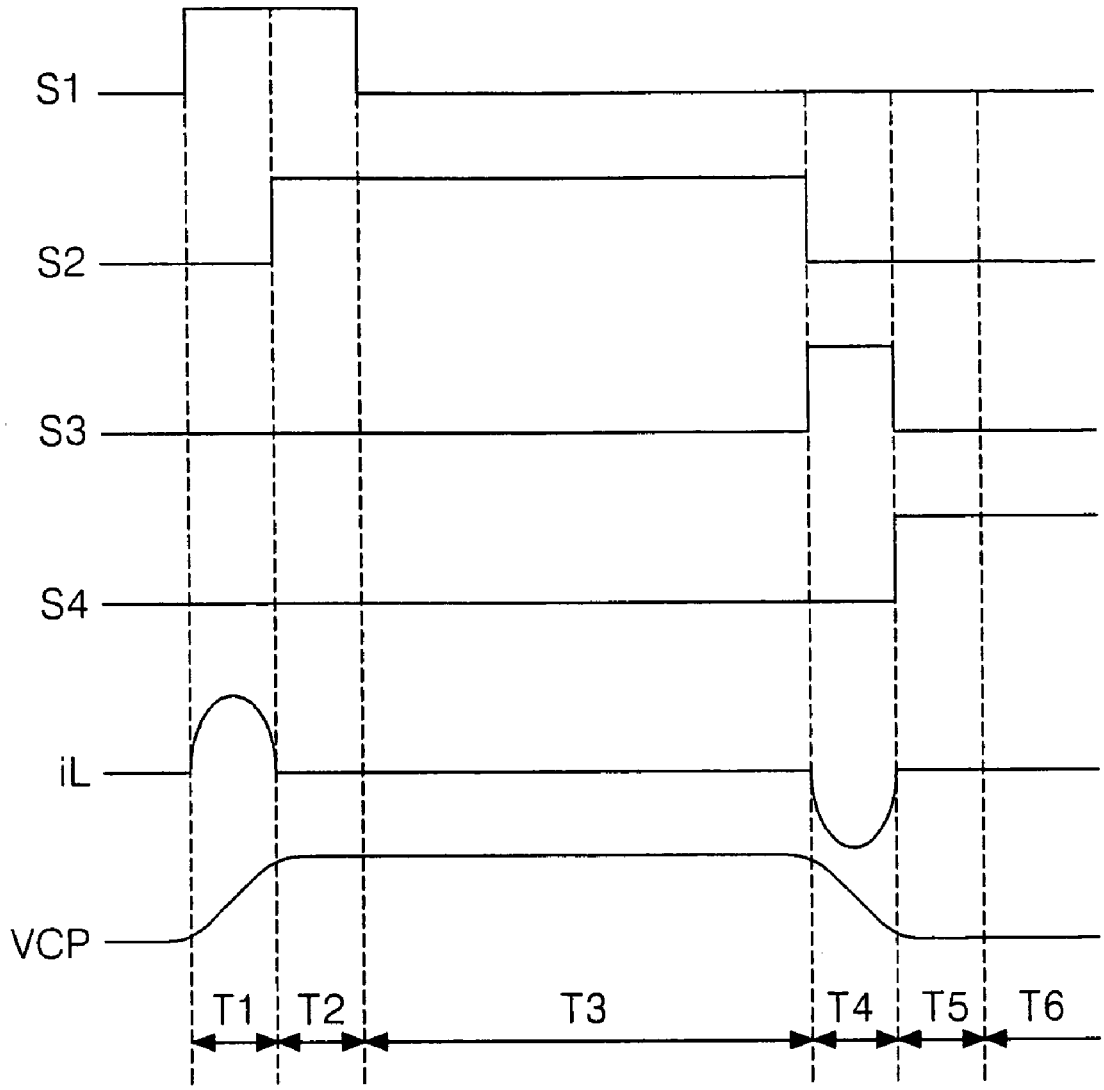
FIG.3 RELATED ART
FIG. 3 is a timing diagram and a waveform diagram representing an ON/OFF timing of each switch shown in FIG. 2 and an output waveform of the panel capacitor.
Figure 4:
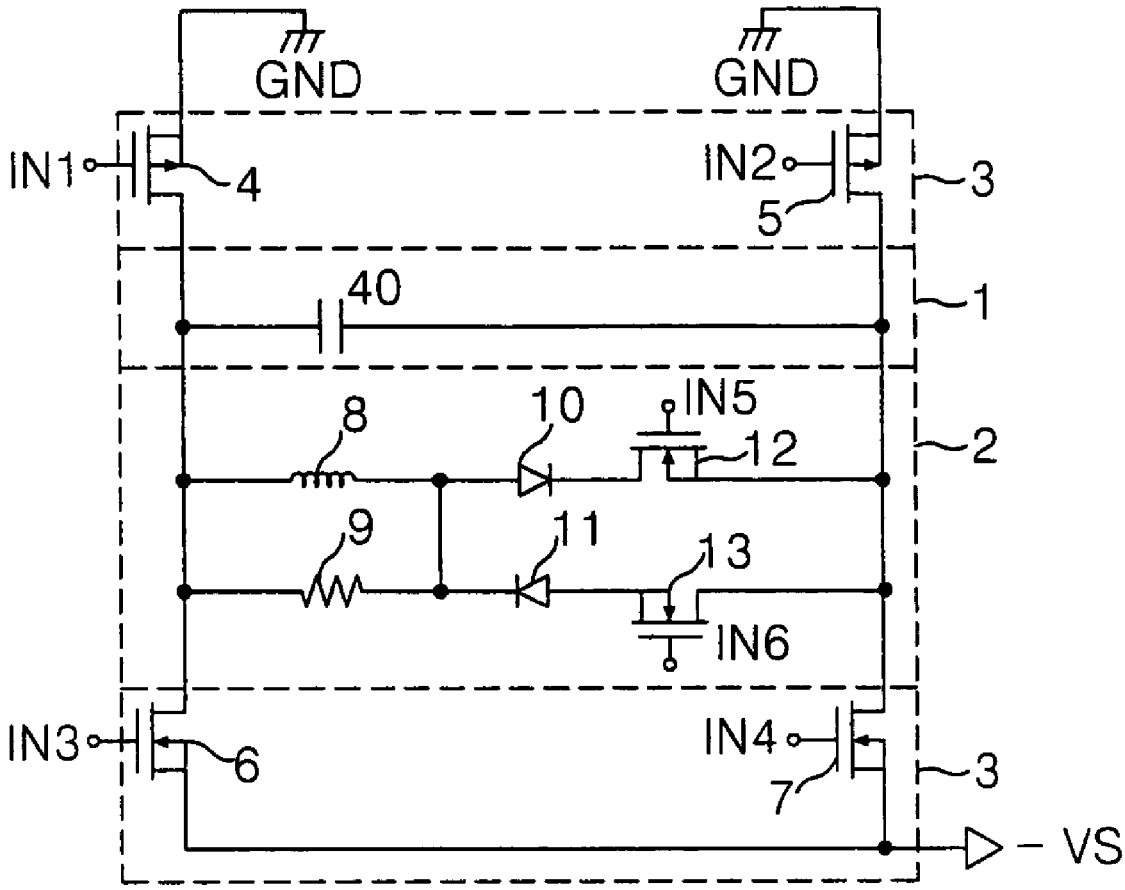
FIG. 4 RELATED ART
FIG. 4 is a circuit diagram of another conventional energy recovering apparatus of a plasma display panel.
Figure 5:
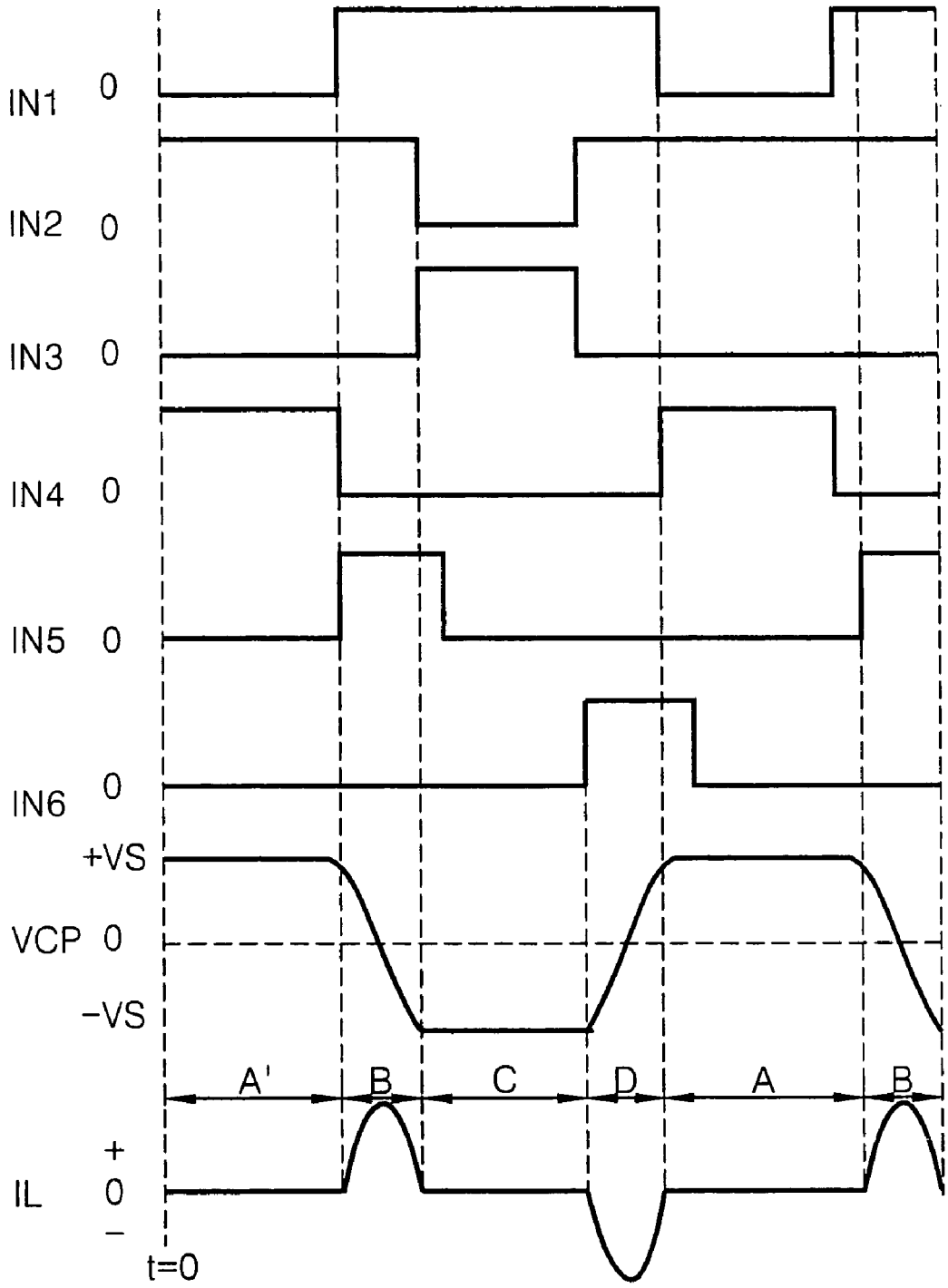
FIG.5 RELATED ART
FIG. 5 is a timing diagram and a waveform diagram representing an ON/OFF timing of each switch shown in FIG. 4 and an output waveform of the panel capacitor.
Figure 6A:
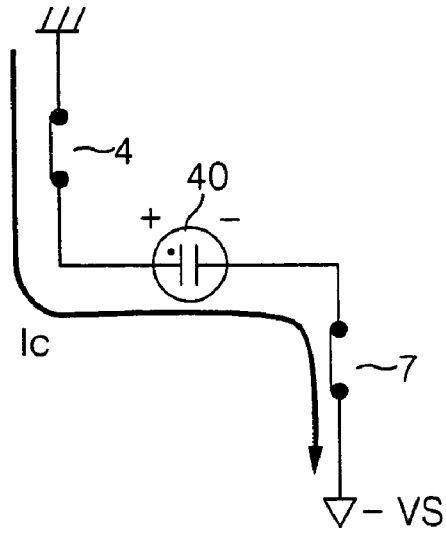
FIG.6A RELATED ART
FIG. 6A is a circuit diagram representing an ON/OFF state and a current path of the switching device in the A' period shown in FIG. 5.
Figure 6C:
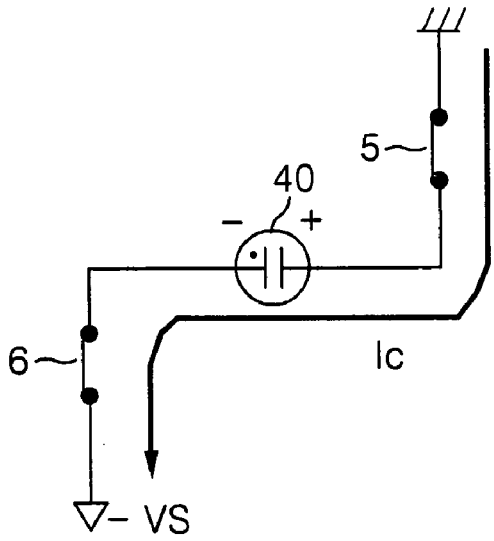
FIG.6C RELATED ART
FIG. 6C is a circuit diagram representing an ON/OFF state and a current path of the switching device in the C period shown in FIG. 5.
Figure 6B:
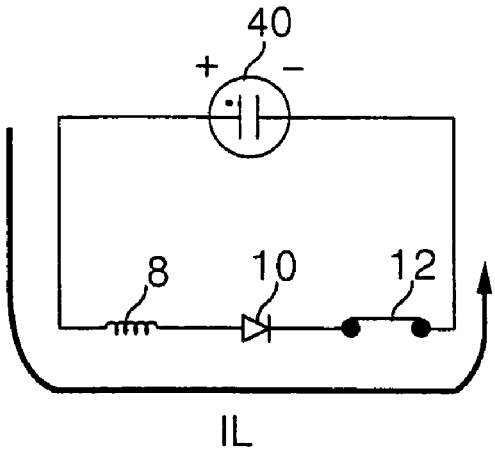
FIG.6B RELATED ART
FIG. 6B is a circuit diagram representing an ON/OFF state and a current path of the switching device in the B period shown in FIG. 5.
Figure 6D:
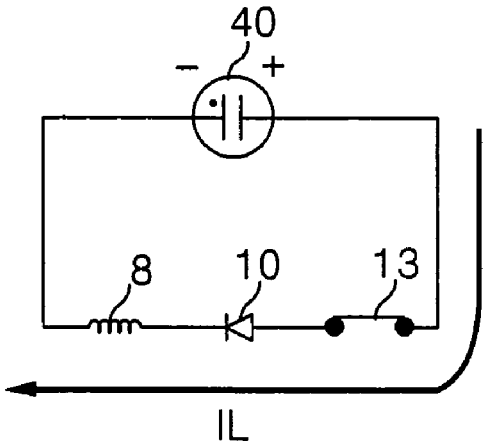
FIG.6D RELATED ART
FIG. 6D is a circuit diagram representing an ON/OFF state and a current path of the switching device in the D period shown in FIG. 5.
Figure 6E:
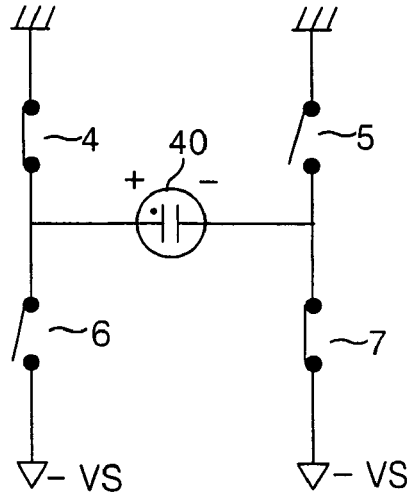
FIG.6E RELATED ART
FIG. 6E is a circuit diagram representing an ON/OFF state and a current path of the switching device in the A period shown in FIG. 5.
Figure 7:
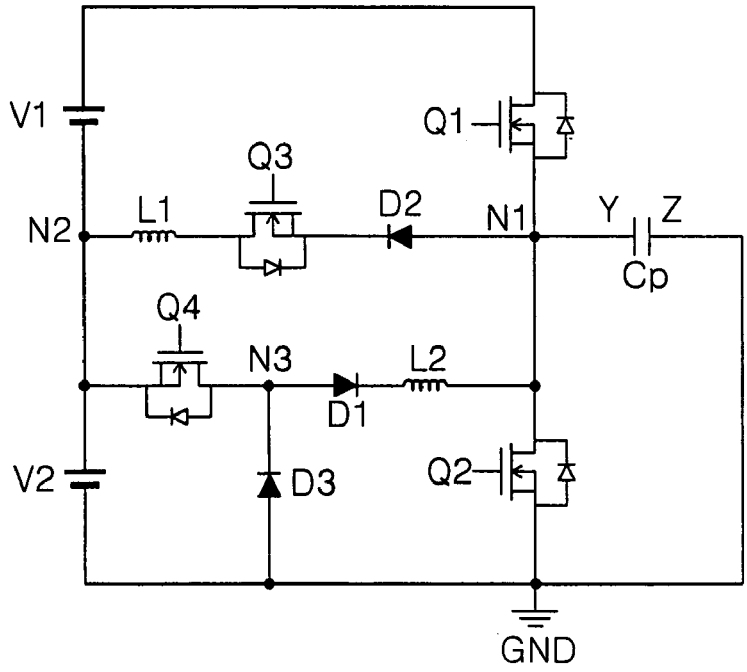
FIG. 7 is a circuit diagram of an energy recovering apparatus of a plasma display panel according to embodiments of the present invention.

Referring to FIG. 7, there is shown an energy recovering apparatus of a plasma display panel (PDP) according to the embodiment of the present invention.

The energy recovering apparatus includes a panel capacitor Cp that is an equivalent capacitance formed between first and second electrodes Y and Z of the PDP, first and second voltage sources V1 and V2 connected in series, a first inductor L1 connected between a first node N1 connected to the first electrode Y and a second node N2 between the first and second voltage sources V1 and V2, a second inductor L2 connected between the first node N1 and the second node N2 and, at the same time, connected, in parallel, to the first inductor L1, first and second switches Q1 and Q2 connected, in parallel, to the panel capacitor Cp with having the first node N1 therebetween, a third switch Q3 connected between the first inductor L1 and the first node N1, a fourth switch Q4 connected between the second node N2 and the second inductor L2, and first to third diodes D1 to D3 for limiting a current direction on a current path.

The first voltage source V1 generates a +Vs/2 voltage equal to a half the sustain voltage +Vs supplied to the panel capacitor Cp. The second voltage source V2 generates a +Vs/2 voltage equal to a half the sustain voltage +Vs supplied to the panel capacitor Cp.

The first inductor L1 recovers electric charges with the aid of a natural LC resonance provided by itself and the panel capacitor Cp to store them into a capacitor included in the second voltage source V2.

The second inductor L2 stores electric charges from the second voltage source V2 during a period when the panel capacitor Cp has kept at a ground level GND, and generates an inverse voltage using electric charges stored in response to a switching of the second switch Q2 to supply it to the panel capacitor Cp.

Each of the first and second switches Q1 and Q2 are connected, in parallel, to the first electrode Y of the panel capacitor Cp, that is, to the first node N1.

Such first to fourth switches Q1 to Q4 are sequentially turned on to thereby control a flow of current. The first switch Q1 forms a current path between the panel capacitor and the first and second voltage sources V1 and V2 for keeping a voltage of the panel capacitor Cp at a sustain voltage +Vs. The second and fourth switches Q2 and Q4 forms a current path between the second voltage source V2 and the second inductor L2 for charging electric charges from the second voltage source V2 into the second inductor L2, or a current path between the second inductor L2 and the panel capacitor Cp which is turned off at the same time to generate an inverse voltage using electric charges stored in the second inductor L2 and supply the generated inverse voltage to the panel capacitor Cp. The third switch Q3 forms a current path between the panel capacitor Cp and the first inductor L1 for charging electric charges of the panel capacitor Cp, via the first inductor L1, into the capacitor included in the second voltage source V2.

A diode is connected, in parallel, to each of the first to fourth switches Q1 to Q4. The diodes can be used as internal diodes of the first to fourth switches Q1 to Q4. Alternatively, the diodes may be used as external diodes thereof. Each of the first to fourth switches Q1 to Q4 employs any one of semiconductor switching devices such as a metal oxide semiconductor field-effect transistor (MOSFET), an insulated gate bipolar transistor (IGBT), a silicon-controlled rectifier (SCR), a bipolar junction transistor (BJT) and a high electron mobility transistor (HEMT), etc.

A first diode D1 is connected between the second switch Q2 and the fourth switch Q4 to shut off a backward current from the second inductor L2. A second diode D2 is connected between the first node N1 and the third switch Q3 to shut off a backward current going through the third switch Q3. Further, a third diode D3 is connected between a third node N3 positioned between the fourth switch Q4 and the first diode D1 and other terminal of the second voltage source V2.

Figure 8:
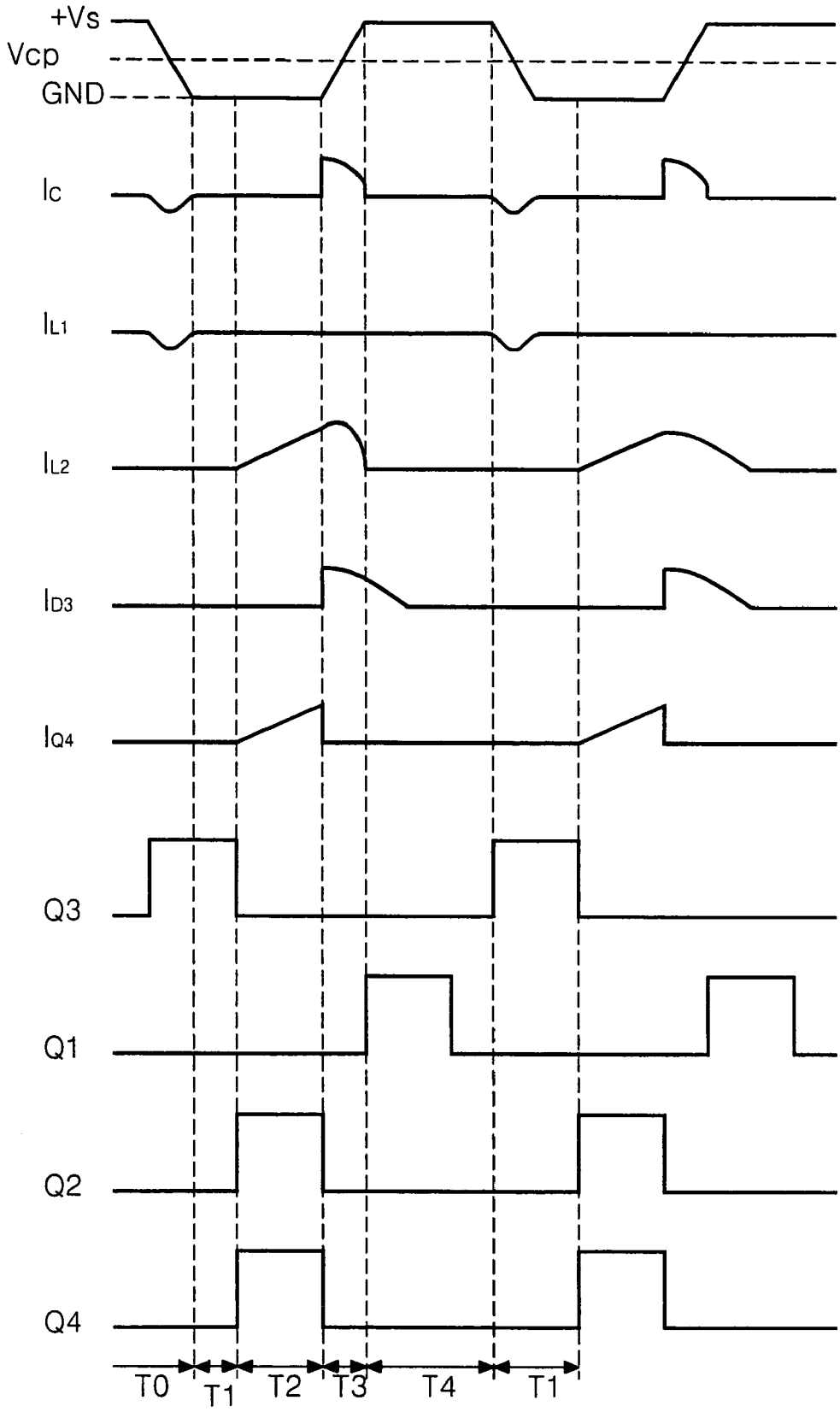
FIG. 8 is a timing diagram and a waveform diagram representing an ON/OFF timing of each switch shown in FIG. 7 and an output waveform of the panel capacitor.

FIG. 8 is a timing diagram and a waveform diagram representing an ON/OFF timing of each switch shown in FIG. 7 and a voltage applied to the panel capacitor.

An energy recovering apparatus and method according to the embodiment of the present invention in FIG. 8 will be described in conjunction with FIG. 7.

First, it is assumed that a sustain voltage +Vs has been charged in the panel capacitor Cp prior to a T1 period.

Figure 9:
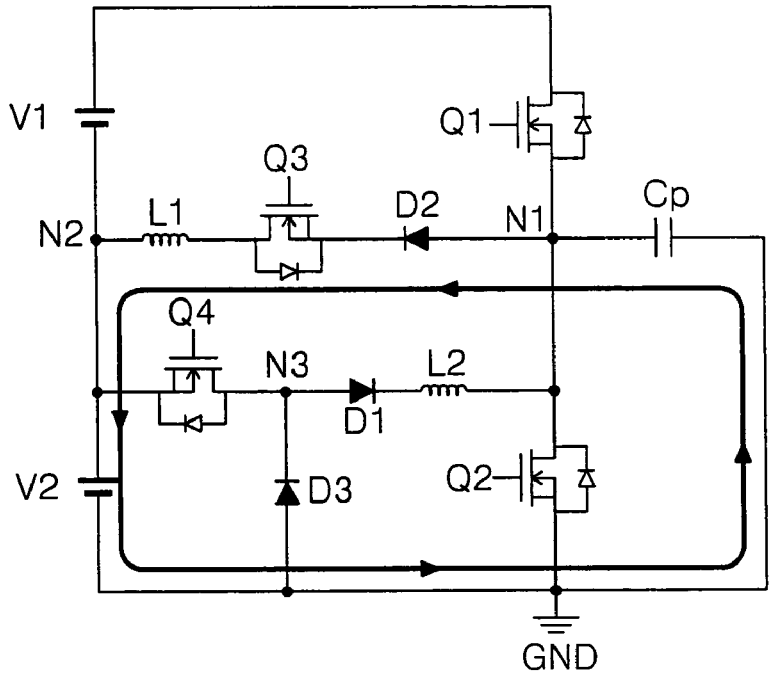
FIG. 9 is a circuit diagram representing an ON/OFF state and a current path of the switching device in the T1 period shown in FIG. 8.

Thus, in a T1 period, only the third switch Q3 of the first to fourth switches Q1 to Q4 is turned on, to thereby form a current path extending from the panel capacitor Cp, via the first node N1, the second diode D2, the third switch Q3, the first inductor L1, the second node N2 and the second voltage source V2, into the panel capacitor Cp as shown in FIG. 9. Thus, the first inductor L1 recovers electric charges of the panel capacitor Cp through said current path to charge them into a capacitor included in the second voltage source V2. Accordingly, a voltage Vcp of the panel capacitor Cp falls from the sustain voltage +Vs into the ground level GND.

Figure 10:
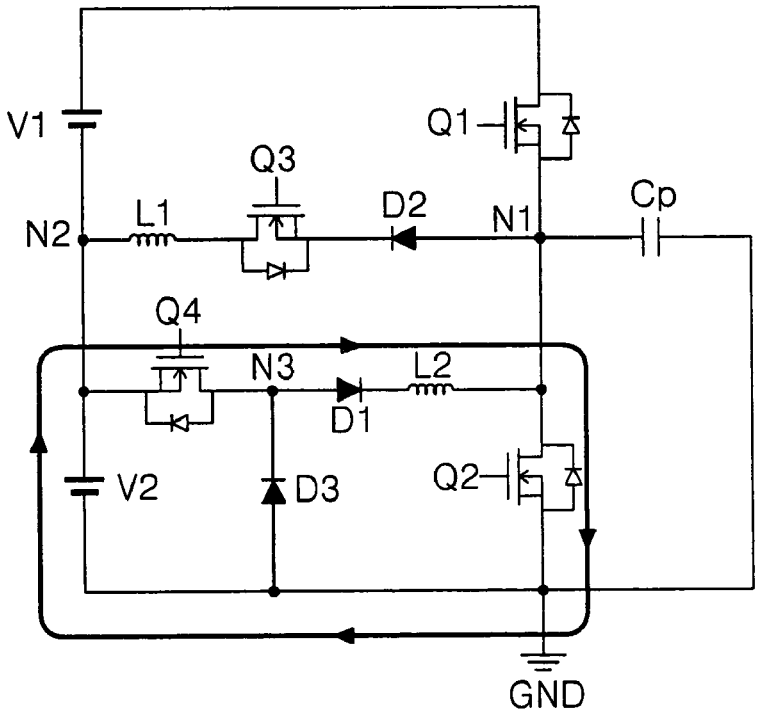
FIG. 10 is a circuit diagram representing an ON/OFF state and a current path of the switching device in the T2 period shown in FIG. 8.

In a T2 period, the third switch Q3 is turned off while the second and fourth switches Q2 and Q4 are turned on, to thereby form a current path extending from the second voltage source V2, via the fourth switch Q4, the third node N3, the first diode D1, the second inductor L2 and the second switch Q2, into the second voltage source V2 as shown in FIG. 10. Thus, the second inductor L2 charges electric charges from the second voltage source V2, and the panel capacitor Cp keeps a state of ground level GND. On the other hand, the second and fourth switches Q2 and Q4 are turned on simultaneously or at a desired time difference to thereby be turned off at the same time.

Figure 11:
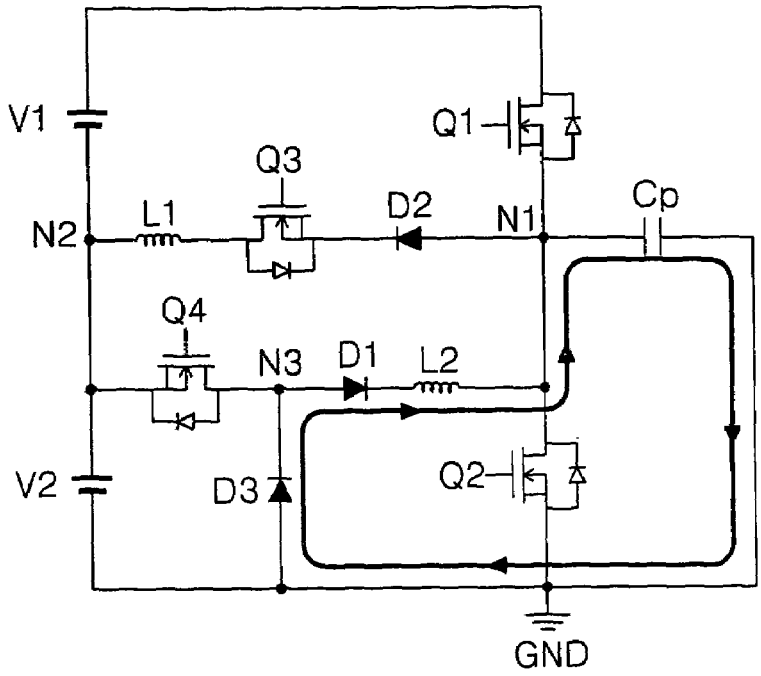
FIG. 11 is a circuit diagram representing an ON/OFF state and a current path of the switching device in the T3 period shown in FIG. 8.

In a T3 interval, the second and fourth switches Q2 and Q4 are turned off to turn off all of the first to fourth switches Q1 to Q4, thereby forming a current path extending from the second inductor L2, via the first node N1, the panel capacitor Cp, the third diode D3, the third node N3 and the first node D1, into the second inductor L2 as shown in FIG. 11. Thus, the second inductor L2 generates an inverse voltage using electric charges stored in the T2 period by a turning-off of the second and fourth switches Q2 and Q4. The inverse voltage generated at the second inductor L2 by the turning-off of the second and fourth switches Q2 and Q4 is applied to the panel capacitor Cp with the aid of a resonance provided by the inductor L2 and the panel capacitor Cp on said current path. Accordingly, the voltage Vcp of the panel capacitor Cp rapidly rises from the ground level GND into the sustain voltage +Vs. In other words, the inverse voltage generated at the second inductor L2 allows electric charges stored in the second inductor L2 in the T2 period to be generated by the turning-off of the second and fourth switches Q2 and Q4.

Figure 12:
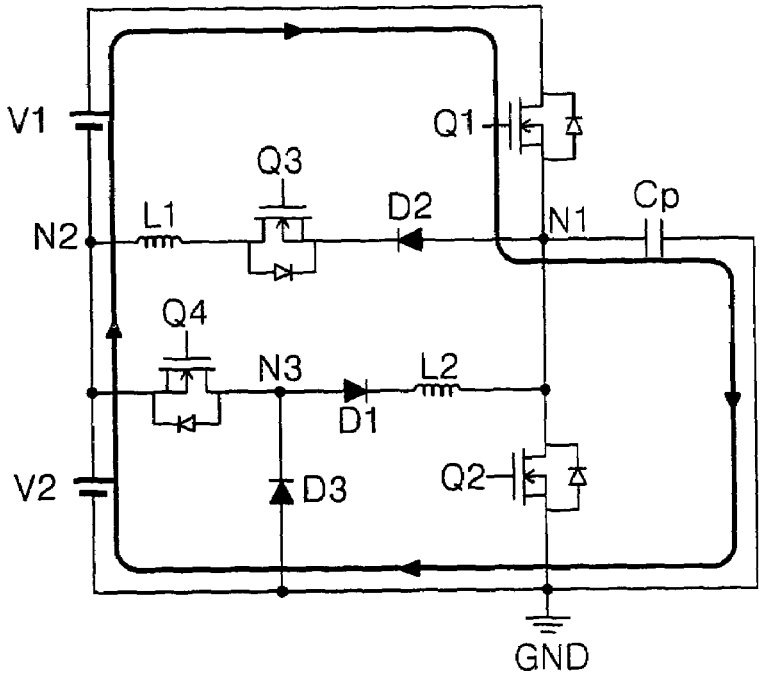
FIG. 12 is a circuit diagram representing an ON/OFF state and a current path of the switching device in the T4 period shown in FIG. 8.

In a T4 period, only the first switch Q1 of the first to fourth switches Q1 to Q4 is turned on, to thereby form a current path extending from the second voltage source V2, via the second node N2, the first voltage source V1, the first switch S1, the first node N1 and the panel capacitor Cp, into the second voltage source V2 as shown in FIG. 12. Thus, the panel capacitor Cp receives voltages from the first and second voltage sources V1 and V2 connected, in series, on said current path to keep a sustain voltage +Vs in the T3 period.

Consequently, after the T4 period, the energy recovering method for the PDP according to the embodiment of the present invention repeats the above-mentioned T1 to T4 periods. In other words, the energy recovering method for the PDP according to the embodiment of the present invention periodically repeats the T1 to T4 periods to thereby supply an alternating current sustain pulse Vcp to the panel capacitor Cp. In real, the alternating current driving pulse Vcp applied to the first and second electrodes Y and Z of the PDP is generated with repeating the above-mentioned T1 to T4 periods periodically.

Such an energy recovering apparatus and method of the PDP according to the embodiment of the present invention recovers electric charges of the panel capacitor Cp using the first inductor L1 to store the recovered electric charges into the second voltage source V2 and stores the electric charges from the second voltage source V2 in which the recovered electric charges have been stored, and applies an inverse voltage generated at the second inductor L2 by the second and fourth switches Q2 and Q4 to the panel capacitor Cp. Thus, it is possible to obtain a rapid rising slope of the sustain voltage applied to the panel capacitor Cp. Accordingly, the energy recovering apparatus and method of the PDP according to the embodiment of the present invention can generate a sustain voltage having a fast rising time, thereby using a switching device having a low resisting-voltage.

As described above, the energy recovering apparatus of the PDP according to the present invention recovers an energy of the panel capacitor into the voltage source through the first inductor connected to the panel capacitor, and stores the recovered energy to the second inductor and thereafter applies an inverse voltage generated at the second inductor to the panel capacitor. Thus, the energy recovering apparatus of the PDP according to the present invention can obtain a fast rising slope of the sustain voltage. Accordingly, the energy recovering apparatus of the PDP according to the present invention has a fast rising slope of the sustain voltage, so that it can use switching devices having a low resisting-voltage.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An energy recovering apparatus of a plasma display panel, comprising:

said plasma display panel;

a voltage source for supplying a sustain voltage to the panel;

a first inductor for recovering an energy stored in the panel into the voltage source;

a second inductor for receiving an energy from the voltage source in which the recovered energy has been stored to charge the received energy; and switching devices for shutting off a path between the voltage source and the second inductor in a state in which energy has been stored in the second inductor to derive an inverse voltage into the second inductor and allowing said inverse voltage to be applied to the panel, wherein the voltage source includes:

a first voltage source electrically coupled between the panel and the ground voltage source; and a second voltage source connected between the first voltage source and the ground voltage source.

2. The energy recovering apparatus as claimed in claim 1, wherein each of the first and second voltage sources has a voltage value equal to a half of the sustain voltage.

3. The energy recovering apparatus as claimed in claim 1, further comprising:

a first switch for forming a path between the voltage source and the panel such that said sustain voltage of the voltage source is supplied to the panel;

a second switch for forming a path among the panel, the first inductor and the voltage source such that an energy from the panel is recovered into the voltage source; and a first diode connected between the second switch and the panel.

4. The energy recovering apparatus as claimed in claim 1, wherein the switching devices include:

a first switch connected between a node positioned between the second inductor and the panel and the ground voltage source; and a second switch connected between the second inductor and the second voltage source.

5. The energy recovering apparatus as claimed in claim 4, wherein the switching devices further include:

a first diode connected between the second switch and the second inductor; and a second diode connected between a node positioned between the second switch and the first diode and the ground voltage source.

6. The energy recovering apparatus as claimed in claim 5, wherein the first and second diodes form a path between the second inductor and the panel such that said inverse voltage is supplied to the panel.

7. The energy recovering apparatus as claimed in claim 4, wherein said inverse voltage is generated when the first and second switches are turned off in a turned-on state.

8. An energy recovering method for a plasma display panel, comprising:

(A) supplying a sustain voltage from a voltage source to the panel;

(B) recovering an energy stored in the panel into the voltage source using a first inductor;

(C) receiving an energy from the voltage source in which the recovered energy has been stored to thereby charge the energy into a second inductor; and (D) shutting off a path between the voltage source and the second inductor in a state in which an energy has been stored in the second inductor using the switching devices to derive an inverse voltage into the second inductor and applying said inverse voltage to the panel, wherein supplying the sustain voltage includes:

forming a path between the first and second voltage sources and the panel connected in series using a first switch to thereby apply voltages from the first and second voltage sources to the panel.

9. The energy recovering method as claimed in claim 8, wherein recovering the energy includes:

forming a path between the panel and the second voltage source going by way of the first inductor using a second switch connected between the first inductor and the panel to thereby recover energy of the panel into the second voltage source.

10. The energy recovering method as claimed in claim 8, wherein receiving the energy from the voltage source includes:

forming a path between the second voltage source and the second inductor using a third switch connected between the second voltage source and the second inductor and a fourth switch connected between the second inductor and a ground voltage source.

11. The energy recovering method as claimed in claim 10, wherein said inverse voltage is generated when the third and fourth switches are turned off in a turned-on state.

12. The energy recovering method as claimed in claim 10, wherein shutting off the path includes:

forming a path among the second inductor, a panel capacitor, a second diode, a first diode and the second inductor using the first diode connected between the third switch and the second inductor and the second diode connected between a node positioned between the first diode and the third switch and the ground voltage source.

13. An energy recovery circuit for a plasma display panel having a panel capacitance, comprising:

a first node for coupling to the panel capacitance;

a second node for coupling to a voltage source;

a first inductor having first and second electrodes, the first inductor being coupled between the first node and the second node;

a second inductor having first and second electrodes, the first electrode of the second inductor being coupled to the first node, and the second electrode of the inductor being coupled to a third node;

a fourth node for coupling to a prescribed voltage;

a first transistor having first and second electrodes, the first electrode of the first transistor being coupled to the first node, and the second electrode of the first transistor being coupled to the fourth node; and a second transistor having first and second electrodes, the first electrode of the second transistor being coupled to the second node, and the second electrode of the second transistor being coupled to the third node, wherein the first and second transistors are turned off during a first prescribed period of time such that a first electrically conductive path is provided through the first node, the fourth node and the third node such that energy stored in the second inductor is provided to the panel capacitance.

14. The energy recovery circuit of claim 13, further comprising a third transistor having first and second electrodes, the first electrode of the third transistor being coupled to the first node, wherein the third transistor is turned on and the first and second transistors are turned off during a second prescribed period of time such that a second electrically conductive path is provided through the first node, fourth node and the second node.

15. The energy recovery circuit of claim 14, further comprising a fourth transistor coupled between the first and second nodes, the fourth transistor having first and second electrodes, the first electrode of the first inductor being coupled to the second node and the second electrode of the first inductor and the second node of the fourth transistor being coupled to each other, wherein during a third prescribed period of time, the fourth transistor is turned on while the first, second and third transistors are turned off such that a third electrically conductive path is formed through the first, second and fourth nodes to allow removal of energy stored in the first inductor.

16. The energy recovery circuit of claim 15, wherein during a fourth prescribed period of time, the first and second transistors are turned on while the third and fourth transistors are turned off such that a fourth electrically conductive path is formed through the first, fourth and second nodes to store energy in the second inductor.

17. The energy recovery circuit of claim 16, further comprising:

a first diode coupled between the second inductor and the third node;

a second diode coupled between the first node and the fourth transistor; and a third diode coupled between the third and fourth nodes.

18. The energy recovery circuit of claim 14, wherein the voltage source comprises a first voltage source coupled to the second node and the second electrode of the third transistor, and a second voltage source coupled to the second node and the fourth node, the first voltage source having a voltage value equal to the second voltage source.

19. The energy recovery circuit of claim 13, wherein the prescribed voltage is a ground voltage.

* * * * *